US005400850A

United States Patent [19]

Flemming et al.

[11] Patent Number: 5,400,850

[45] Date of Patent: Mar. 28, 1995

[54] PLANT FOR PRODUCTION OF STEEL STRIP

[75] Inventors: Gunter Flemming; Hans Streubel, both of Erkrath; Wolfgang Rohde, Dormagen, all of Germany

[73] Assignee: SMS Schloemann-Siemag Aktiengesellschaft, Dusseldorf, Germany

[21] Appl. No.: 265,333

[22] Filed: Jun. 24, 1994

Related U.S. Application Data

[62] Division of Ser. No. 947,708, Sep. 18, 1992, Pat. No. 5,339,887.

[30] Foreign Application Priority Data

Sep. 19, 1991 [DE] Germany ..... 41 31 116.7
Oct. 25, 1991 [DE] Germany ..... 41 35 214.9

[51] Int. Cl.[6] ..... B22D 11/12; B21B 1/46
[52] U.S. Cl. ..... 164/417; 164/424
[58] Field of Search ..... 164/417, 424, 476, 477

[56] References Cited

U.S. PATENT DOCUMENTS

| | | | |
|---|---|---|---|
| 3,747,664 | 7/1973 | Schoffmann | 164/476 |
| 4,540,037 | 9/1985 | Langner | 164/477 X |
| 4,815,520 | 3/1989 | Wuetig | 164/417 X |
| 4,955,428 | 9/1990 | Schrewe | 164/417 |
| 5,018,569 | 5/1991 | Burau et al. | 164/477 X |

FOREIGN PATENT DOCUMENTS

| | | | |
|---|---|---|---|
| 59-97747 | 6/1984 | Japan | 164/476 |
| 61-132247 | 6/1986 | Japan | 164/476 |
| 63-286260 | 11/1988 | Japan | 164/476 |

*Primary Examiner*—J. Reed Batten, Jr.
*Attorney, Agent, or Firm*—Wolf, Greenfield & Sacks

[57] ABSTRACT

The apparatus includes a set of no more than three pairs of deformation rollers for deforming the continuous cast strip. A drive device positioned downstream of the deformation rollers drives the cast strip. Guide rollers are positioned downstream of the deformation rollers.

10 Claims, 4 Drawing Sheets

PLANT FOR PRODUCTION OF STEEL STRIP

This application is a division of application Ser. No. 07/947,708, filed Sep. 18, 1992, and now U.S. Pat. No. 5,339,887.

FIELD OF THE INVENTION

The invention concerns a process for the production of steel strip, whereby a continuously cast steel strip, which consists of a solidified casting shell and a liquid core, is reduced in thickness by roll deformation, and is then rolled.

BACKGROUND OF THE INVENTION

In the case of this process which is known from EP-A1,0 286,862, a steel strip of 40–50 mm thickness cast in a continuous ingot mold is pressed by a pair of rolls after leaving the mold in such a way that the inner walls of the casting shell formed in the mold are welded together.

In continuous casting in a continuous mold of given length, the thickness of the casting shell which is formed is essentially dependent on the casting speed. In order to assure a constant roll gap, the rolling force must be adapted to the instantaneous casting shell thickness. With a casting speed that is too slow, the available rolling force is no longer sufficient, so that the required thickness of the steel strip produced is exceeded. With too high a casting speed, a welding of the casting shell can only be produced by going below the required thickness of the produced steel strip.

The task of the invention is to create a process and a plant for conducting the process, whereby unwanted fluctuations in thickness of the steel strip produced are avoided and a good structure is obtained. Over and above this, a simplification of the deformation unit as well as a reduction in its energy requirement will be achieved.

SUMMARY OF THE INVENTION

The proposed task will be resolved according to the invention by casting a steel strip billet of 40–80 mm thickness, by roll deforming the steel strip billet to 15–40 mm thickness and 2–15 mm residual liquid core in a maximum of three steps, and guiding the steel strip billet for complete solidification in a way that is free of deformation.

In this way, casting speed and strip thickness can be freely adapted to each other in order to obtain high production outputs. A dense-core and segregation-free structure will be obtained. A simplification of construction and energy savings result from reducing the screw-down force of the deformation unit.

The thickness of the casting shell is advantageously 6–19 mm prior to roll deformation.

According to another feature of the invention, the degree of roll deformation is 10–60% and can be changed during casting.

At a casting speed of 2–10 m/min, the roll-deformed casting is guided parallelly over a length of 1–5 m.

The steel strip is adjusted to the rolling temperature after solidification is complete and is rolled.

In the embodiment of the invention with respect to the device, in a plant for conducting the process, a segment for continuous solidification consisting of support rollers and a drive device are arranged behind a steel-strip casting mold with a maximum of three pairs of deformation rollers.

The deformation rollers and/or support rollers are provided with a mechanical positioning device and a hydraulic pressing device.

BRIEF DESCRIPTION OF THE DRAWINGS

Examples of embodiment with the features and advantages of the invention are presented in the drawing. Here.

DETAILED DESCRIPTION OF THE PREFERRED EMBODIMENT

Figure 1:
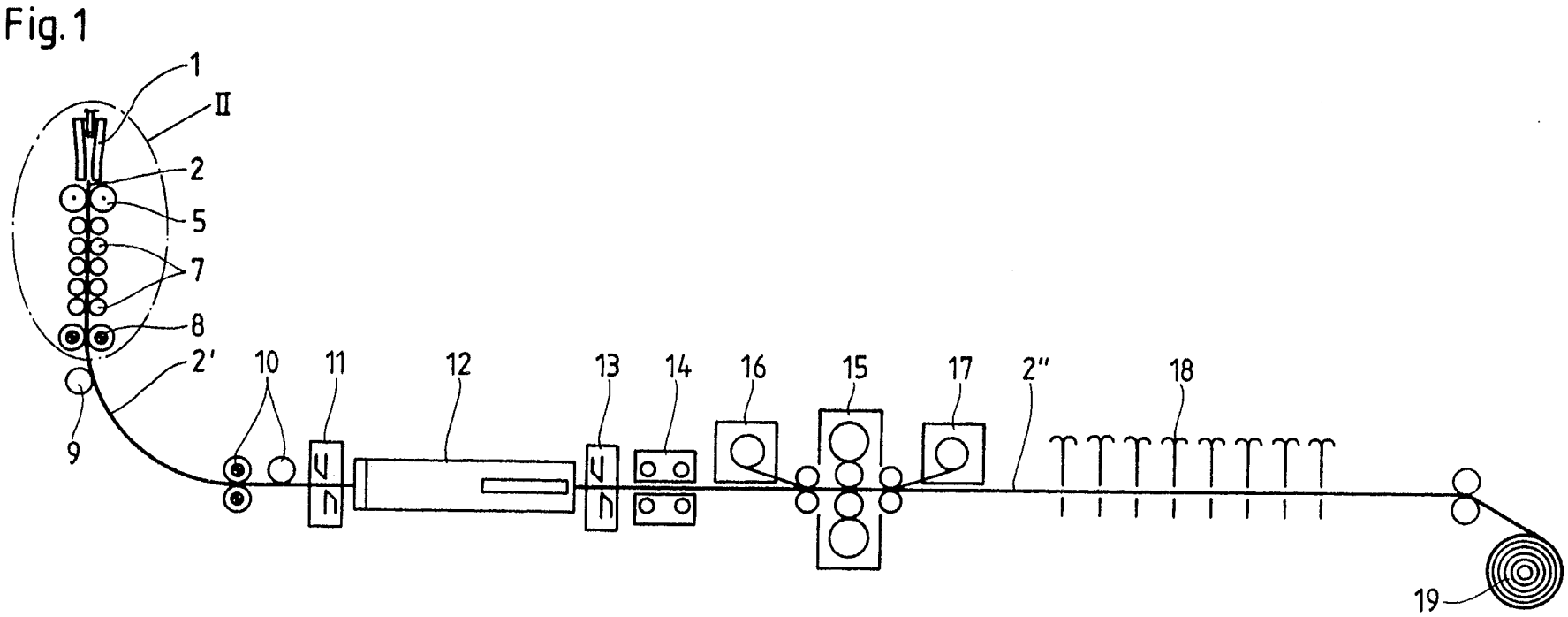
FIG. 1 shows in principle a plant for the production of steel strip.

A plant according to FIG. 1 consists of a mold 1 for casting a steel strip billet 2 of 40–80 mm thickness, a pair of deforming rollers 5, guide rollers 7, and drive rollers 8. A bending roller 9 is provided for deflecting the steel strip. Steel strip 2' then reaches a drive device 10 and can be divided by a cutter 11. The segments of steel strip then pass through an oven 12 for temperature adjustment, to which is subsequently connected another cutter 13 and a descaling device 14.

A Steckel roll mill arranged in the material flow consists of a roll stand 15 with upstream and downstream connected winding ovens 16, 17. A steel strip 2'' leaving the Steckel mill passes through a laminar cooling section 18 and is then wound up on a reel 19.

Figure 2:
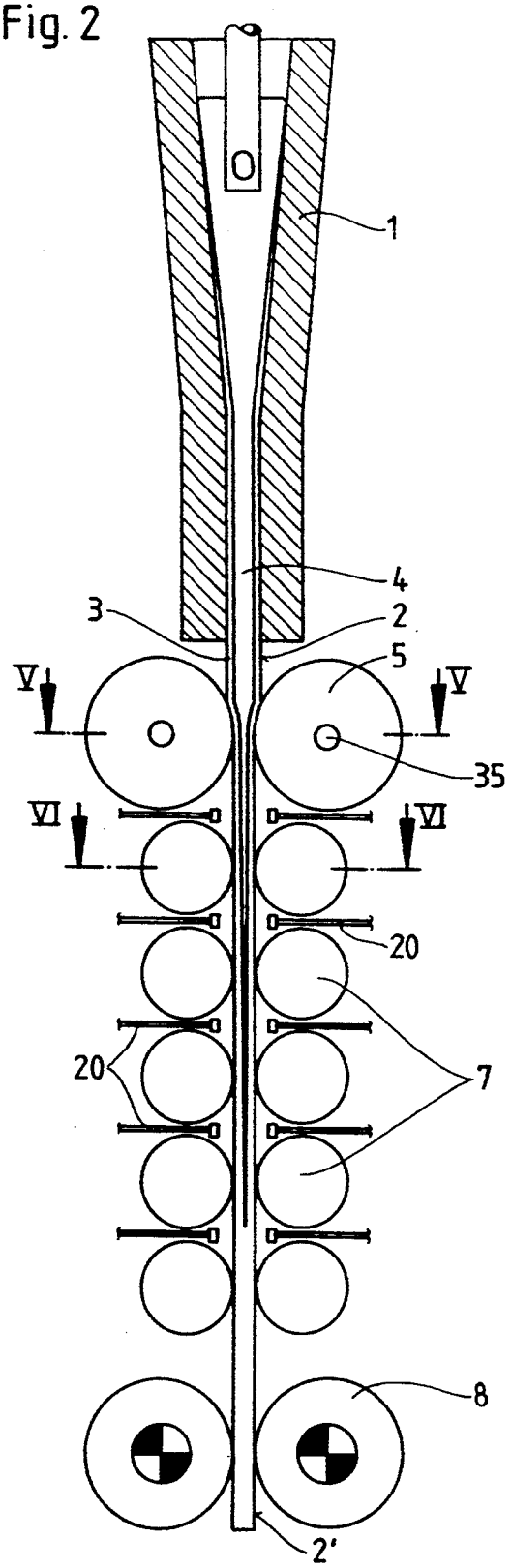
FIG. 2 shows schematically a first segment of the plant from the mold up to the drive device.
Figure 3:
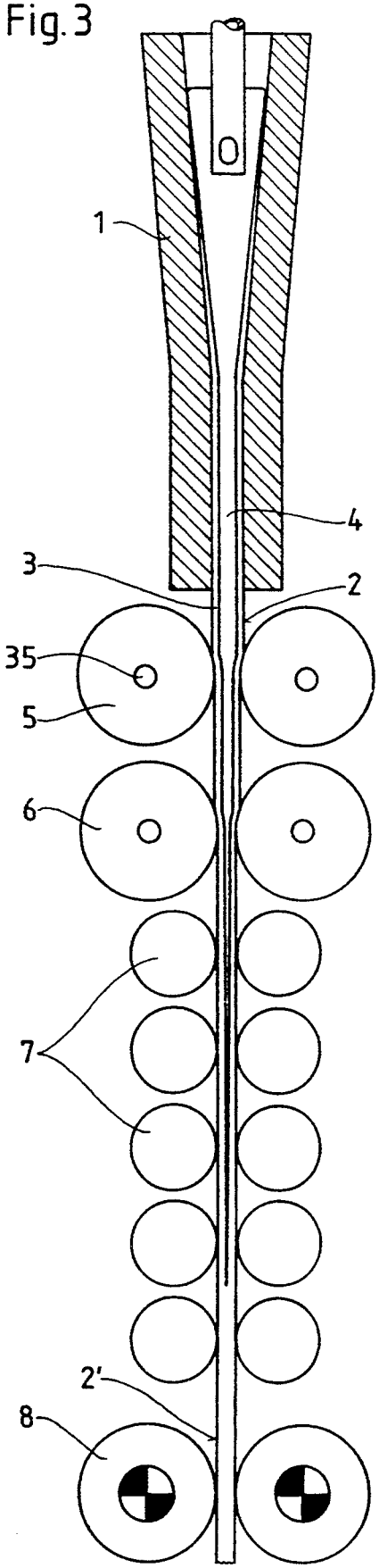
FIG. 3 shows an alternative to FIG. 2 with two pairs of deformation rollers.
Figure 4:
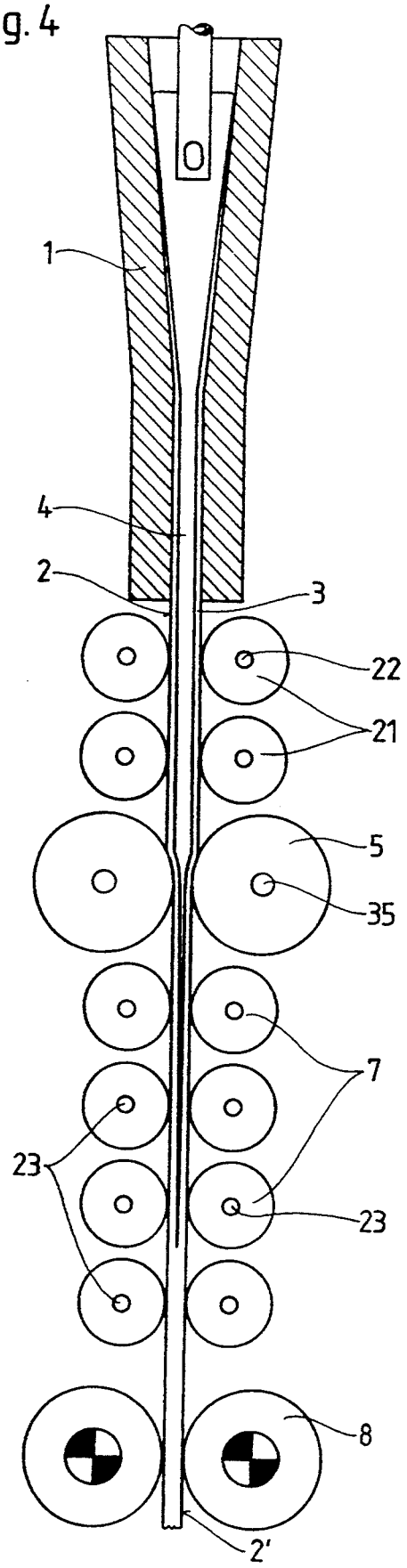
FIG. 4 shows another alternative with pairs of support rollers arranged in front of a pair of deformation rollers.

The production steps for steel strip 2, 2' in the continuous casting plant can be derived from FIGS. 2–4. A cast billet 2 with liquid core 4 forms from the cast molten steel in mold 1 by cooling and solidification of the casting shell 3.

Casting shells 3 found on the billet produced underneath mold 1 are reduced by deformation rollers 5 (6) provided with inner cooling mechanism 35 at a certain mutual clearance. In this way a billet of 15–40 mm thickness is formed with a residual liquid core 4 of 2–15 mm. The roll-deformed cast billet 2 is guided free of deformation between roller tracks formed by guide rollers 7, whereby complete solidification occurs. The transporting of the billet is effected by drive rollers 8.

In the example of embodiment according to FIG. 2 which is a more detailed view of element II of FIG. 1, the cast billet 2 is roll-deformed in one step between a pair of deformation rollers 5. Alternatively, in the example of embodiment according to FIG. 3, a two-stage roll deformation occurs between the pairs of deformation rolls 5 and 6. A two or even three-step roller deformation is advantageous for steels, for which a high deformation speed or a high degree of deformation are not permitted. Water spray nozzles 20 are arranged between guide rollers 7 for cooling cast billet 2.

In the alternative according to FIG. 4, the cast billet underneath the mold is guided free of deformation first to an adjustment to a grade-specific temperature between support rollers 21. Support rollers 21 and guide rollers 7 have an inner cooling device 22 or 23.

Figure 5:
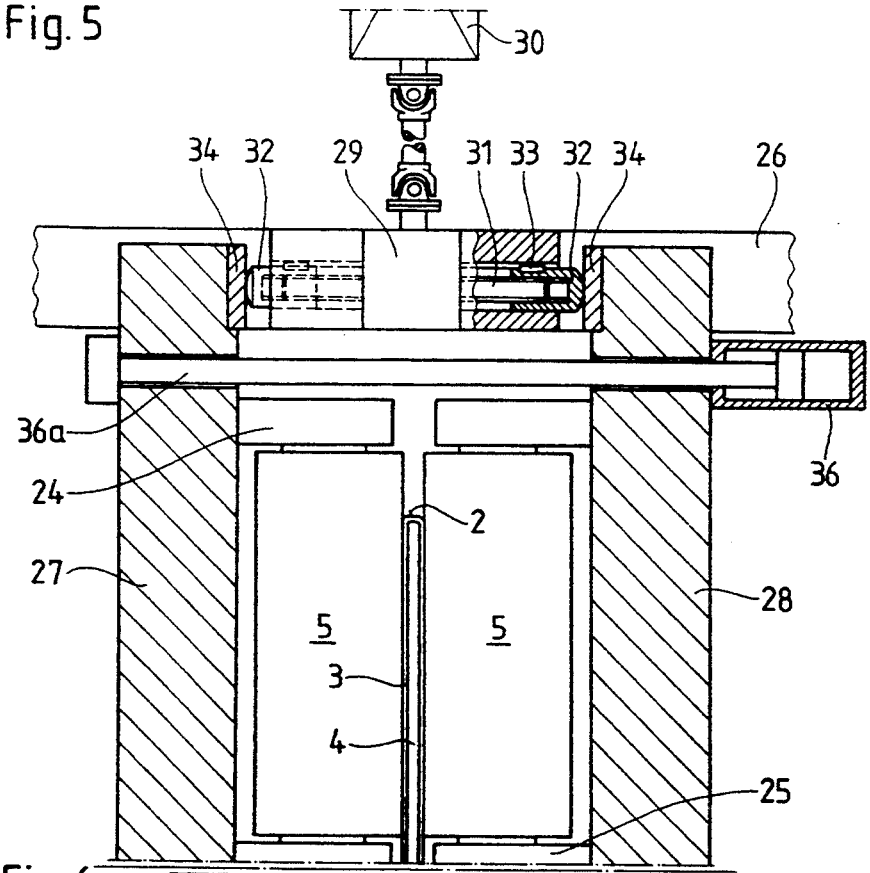
FIG. 5 shows a cross-sectional view of a pair of deformation rollers with a bearing equalizer and a screw-down and positioning device taken along line V—V of FIG. 2.

In the case of the structural configuration shown in FIG. 5, deformation rollers 5 are mounted in between, whereby bearings 24, 25 are attached to equalizers 27, 28, which are guided on both sides and lie opposite each other on supports 26. Spindle drives 29 are attached to supports 26 as a positioning device for equalizers 27, 28 and deformation rollers 5. The spindle drives 29 connected to a motor 30 each have a threaded spindle 31 in the direction of equalizers 27, 28. A spacer nut 32 screwed onto each threaded spindle 31 is secured against rotation by a feather key 33. A catch plate 34 on equalizers 27, 28 is assigned to each spacer nut 32. The equalizers 27, 28 are drawn toward one another by adjustment cylinder 36 with a connecting rod 36*a*, whereby the distance between the equalizers and thus the distance between deformation rollers 5 is determined by the spacer nuts 32 adjusted by spindle drive 29. In this way it is achieved that the pair of deformation rollers 5 remains centered if there is a distance adjustment on the form space of mold 1. A corresponding bearing and adjustment are provided for another pair of deformation rollers 6 (FIG. 3).

Figure 6:
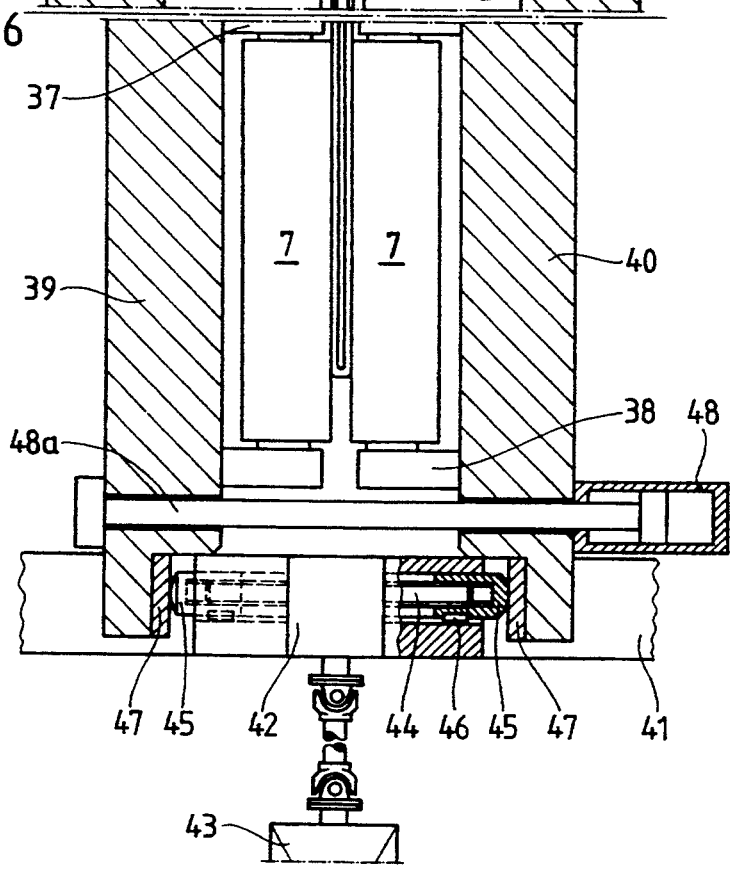
FIG. 6 shows a cross-sectional view of a pair of support rollers with a bearing frame and a screw-down and positioning device taken along line VI—VI of FIG. 2.

In the structural configuration shown in FIG. 6, guide rollers 7 are also intermediately mounted, whereby bearings 37, 38 are mounted on frames 39, 40. Frames 39, 40 are guided on both sides on supports 41.

As a positioning device for frames 39, 40 and guide rollers 7, spindle drives 42 are attached to supports 41. Spindle drives 42 connected to a motor 43 each have a threaded spindle 44 in the direction of frames 39, 40. A spacer nut 45 screwed onto each threaded spindle 44 is secured against rotation by a feather key 46. A catch plate 47 on frames 39, 40 is assigned to each spacer nut 45. Frames 39, 40 are pulled toward each other by adjustment cylinder 48 with a connecting rod 48*a*, whereby their mutual distance and thus the clearance of guide rollers 7 is determined by spacer nuts 45 adjusted by spindle drive 42. In this way it is achieved that guide rollers 7 remain aligned in the case of a distance adjustment on the corresponding deformation rollers 5.

We claim:

1. An apparatus for producing steel strip comprising:

a source of continuously cast steel strip billet, the steel strip billet including a solidified outer casting shell and a residual liquid core;

a set of no more than three pairs of deformation rollers, located downstream of the source, for engaging and deforming the steel strip billet as it passes therethrough, the deformation rollers being positioned so that a residual liquid core is present in the steel strip billet as the steel strip billet exits the set of no more than three pairs of deformation rollers;

a drive device for driving the steel strip billet positioned downstream of the set of no more than three pairs of deformation rollers; and guide rollers positioned downstream of the set of no more than three pairs of deformation rollers.

2. An apparatus according to claim 1, wherein the set of no more than three pairs of deformation rollers include a mechanical positioning device and a hydraulic pressing device.

3. An apparatus according to claim 1, wherein the guide rollers include a mechanical positioning device and a hydraulic pressing device.

4. An apparatus according to claim 1, wherein the set of no more than three pairs of deformation rollers are cooled on the inside and have a diameter of 150–300 mm.

5. An apparatus according to claim 4, wherein the set of no more than three pairs of deformation rollers are disposed over the billet width and are intermediately mounted on a bearing surface.

6. An apparatus according to claim 1, wherein the guide rollers define a parallel guide segment and are coated with a heat-insulating material.

7. An apparatus according to claim 1, wherein the guide rollers are disposed over the billet width and are intermediately mounted on a bearing surface so as to form a complete solidification segment.

8. An apparatus according to any one of claims 1–7, further comprising a bending device and a straightening device, the straightening device being controlled by the drive device.

9. An apparatus according to claim 7, further comprising a temperature adjustment segment and a roll mill positioned downstream from the straightening device.

10. An apparatus according to claim 9, wherein the support rollers are positioned between the source and the set of no more than three pairs of deformation rollers.

* * * * *